US005871338A

United States Patent [19]

Abelen et al.

[11] Patent Number: 5,871,338

[45] Date of Patent: Feb. 16, 1999

[54] VACUUM PUMP WITH A GAS BALLAST DEVICE

[75] Inventors: Thomas Abelen, Koln; Lutz Arndt, Troisdorf; Peter Muller, Koln, all of Germany

[73] Assignee: Leybold Aktiengesellschaft, Germany

[21] Appl. No.: 586,927

[22] PCT Filed: May 26, 1994

[86] PCT No.: PCT/EP94/01678

§ 371 Date: Jan. 29, 1996

§ 102(e) Date: Jan. 29, 1996

[87] PCT Pub. No.: WO95/04223

PCT Pub. Date: Feb. 9, 1995

[30] Foreign Application Priority Data

Jul. 28, 1993 [DE] Germany ..... 43 25 281.8

[51] Int. Cl.[6] ..... F04C 27/02; F04C 29/08

[52] U.S. Cl. ..... 417/296; 417/281; 418/87; 137/118.06

[58] Field of Search ..... 417/278, 281, 417/287, 296, 299; 137/118.06; 62/DIG. 2

[56] References Cited

U.S. PATENT DOCUMENTS

| | | | |
|---|---|---|---|
| 2,637,947 | 5/1953 | Parks | 137/118.06 |
| 3,707,339 | 12/1972 | Budgen | 418/13 |
| 4,844,702 | 7/1989 | Ceccherini et al. | 417/281 |
| 5,066,202 | 11/1991 | Berges et al. | 417/228 |
| 5,236,313 | 8/1993 | Kim | 417/281 |

FOREIGN PATENT DOCUMENTS

| | | | |
|---|---|---|---|
| 0163228 | 5/1985 | European Pat. Off. . | |
| 0597732 | 5/1994 | European Pat. Off. . | |
| 801282 | 12/1950 | Germany | 417/299 |
| 1011115 | 6/1957 | Germany . | |
| 3436849 | 8/1985 | Germany . | |
| 4325282 A1 | 2/1995 | Germany | 418/87 |
| 832264 | 4/1960 | United Kingdom . | |

*Primary Examiner*—Timothy Thorpe
*Assistant Examiner*—Cheryl J. Tyler
*Attorney, Agent, or Firm*—Wall Marjama Bilinski & Burr

[57] ABSTRACT

The invention pertains to a vacuum pump (1) with a closable line (63, 102) through which gas ballast can be fed into the pump chamber (8, 9); to eliminate the danger that a recipient hooked up to the vacuum pump may be charged with air in the event of a pump failure, the invention proposes that the line be equipped with a control valve (59, 60, 61; 98, 99; 109, 110) to regulate the gas ballast feed as a function of operating conditions, such that the line is closed in the event of a pump failure.

23 Claims, 3 Drawing Sheets

VACUUM PUMP WITH A GAS BALLAST DEVICE

BACKGROUND OF THE INVENTION

The invention pertains to a vacuum pump with a closable line through which gas ballast can be fed into the pump chamber of the pump.

In the case of vacuum pumps with an inner compression, there is the danger that sucked in vapours might condense in the pump chamber. No condensation will occur as long as the sucked in vapours are compressed by no more than their saturation vapour pressure. If, for example, water vapour is compressed to a higher pressure than this, the vapours condense in the pump and emulsify with the pump's oil. Thus the lubricating properties of the pump's oil reduce very rapidly so that there is the danger of rotor seizure. By admitting gas, preferably air—gas ballast—into the pump chamber of the pump, sucked in gases may be practically diluted thereby increasing the saturation vapour pressure, so that damaging condensations may not occur. It is known to equip the gas ballast facility with a manually operated valve, so that the gas ballast feed may be blocked off when it is not required.

From DE-A-702 480 vacuum pumps with gas ballast facilities are generally known. The rotary vane vacuum pump presented in drawing FIG. 1 of this document has a gas ballast facility where the quantity of the applied[1)] gas depends on the intake pressure. At a high intake pressure the valve is open; with reducing intake pressure the gas ballast feed is also reduced. In the case of a failure of a vacuum pump of this kind—for example, by a failure of the drive—the recipient is vented more or less rapidly via the gas ballast feed.

[1)] Translator's note: The German text reads . . . zugeführt . . . instead of . . . zugeführte . . . . The latter has been assumed for the translation.

It is known to prevent the recipient from being vented by means of an intake valve which is controlled according to the operating conditions. However, these solutions are involved and are out of the question for cheaper vacuum pump designs. A further possibility to prevent venting of the recipient, is, to ensure that the pump chamber of the pump is hermetically sealed in the case of a pump failure. A solution for this is known from the older application DE-A-42 08 194. In this solution, the oil supply to the pump chamber is blocked in the case of a pump failure, in order to avoid contaminating the recipient with oil vapours. However, functioning of this solution requires that a gas ballast facility not be present, or that it be closed manually prior to the pump failure. Known, so-called hermetically sealed vacuum pumps to date do not offer any protection of the vacuum with the gas ballast switched on.

SUMMARY OF THE INVENTION

It is the task of the present invention to create a vacuum pump of the aforementioned kind, where the danger of venting the recipient via the gas ballast feed does not exist in the case of a pump failure.

This task is solved through the present invention by the characteristic features of the patent claims.

Because the control valve for the gas ballast feed operates depending on the operating conditions and closes in the case of a pump failure, any venting of the recipient via the gas ballast feed can no longer take place. In vacuum pumps with an oil pump, the operation of which depends on the operating conditions, the control valve is preferably actuated by the oil pressure. The oil pressure is a simple and reliable indicator for the operating mode of the vacuum pump. Otherwise hermetically sealed pumps do not require an intake valve for protecting the vacuum.

Further advantages and details of the present invention shall be explained by referring to the design examples presented in drawing FIGS. 1 to 4.

BRIEF DESCRIPTION OF THE DRAWINGS

Drawing

Figure 1:
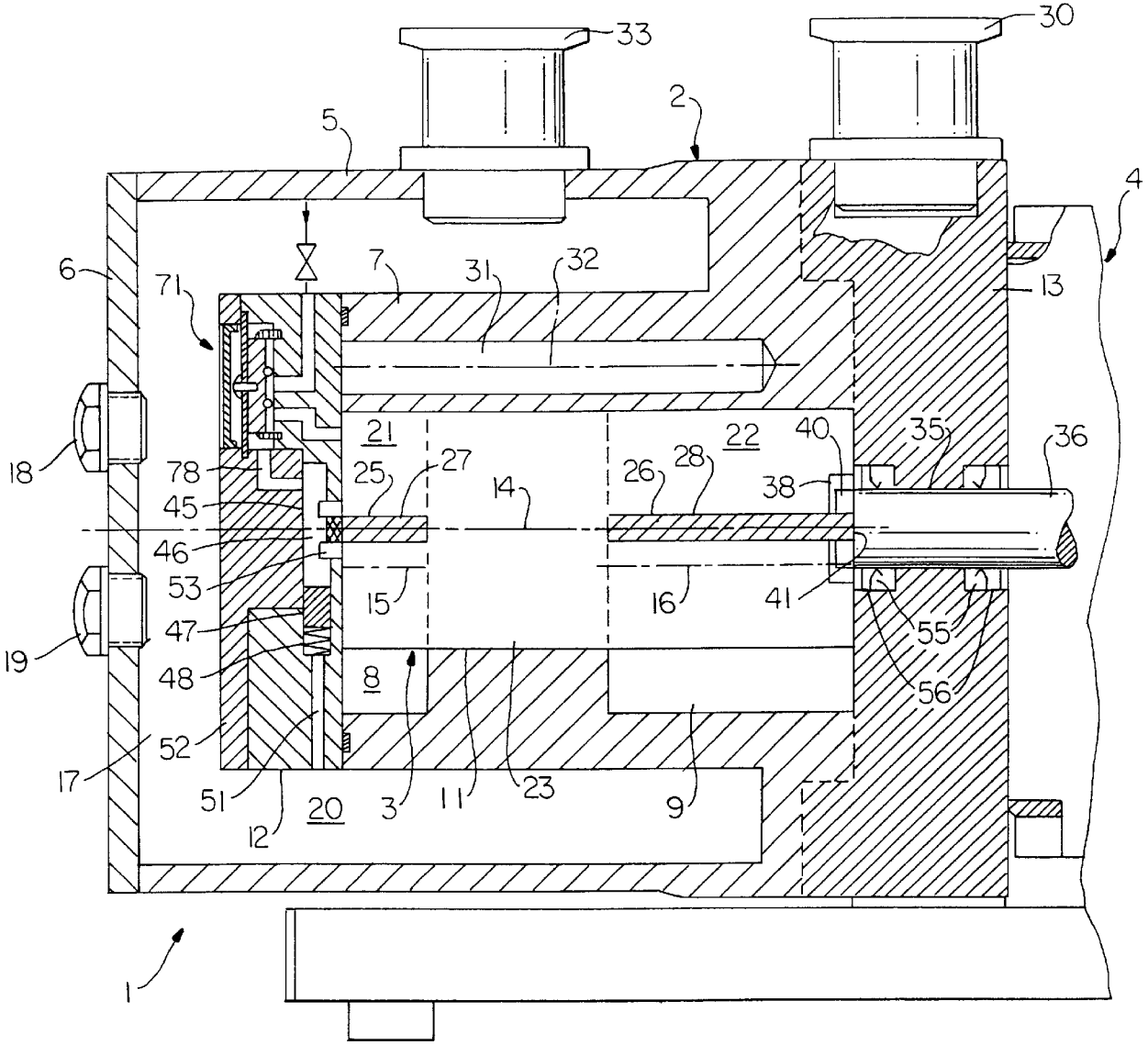
FIG. 1 shows a vacuum pump with a gas ballast feed valve according to the present invention.
Figure 2:
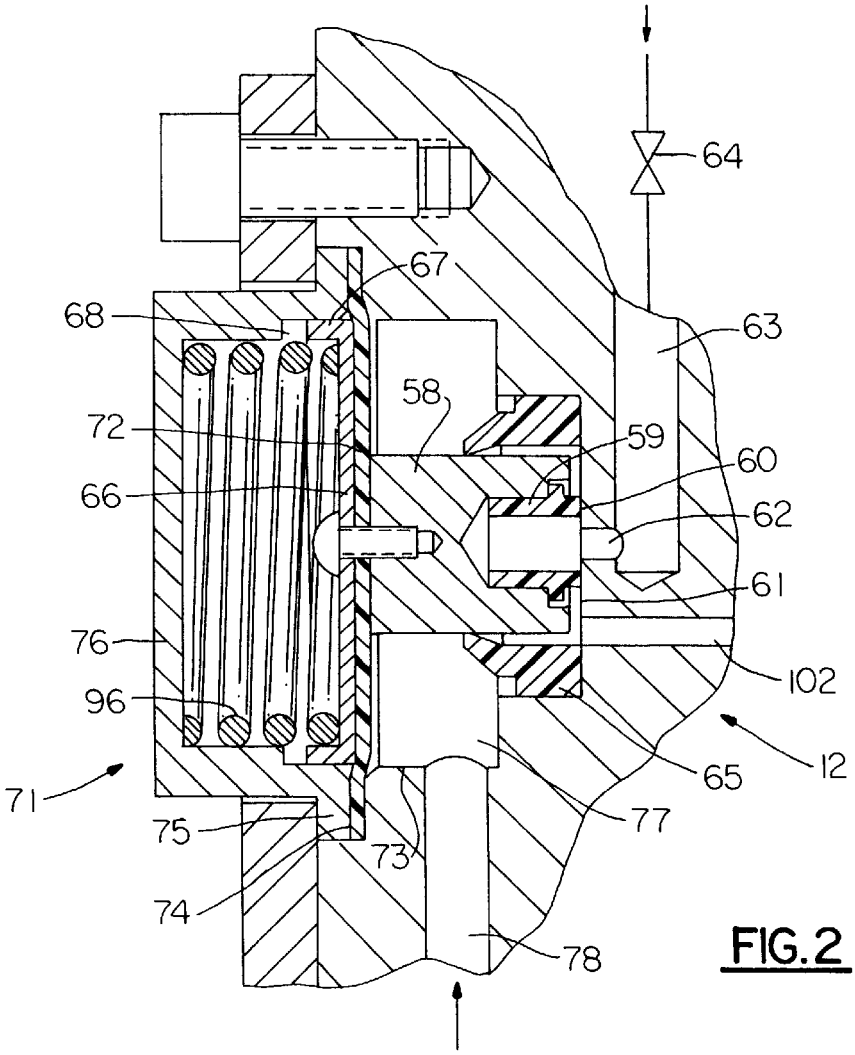

Drawing FIG. 2 enlarges the gas ballast feed valve shown in drawing FIG. 1.

Figure 3:
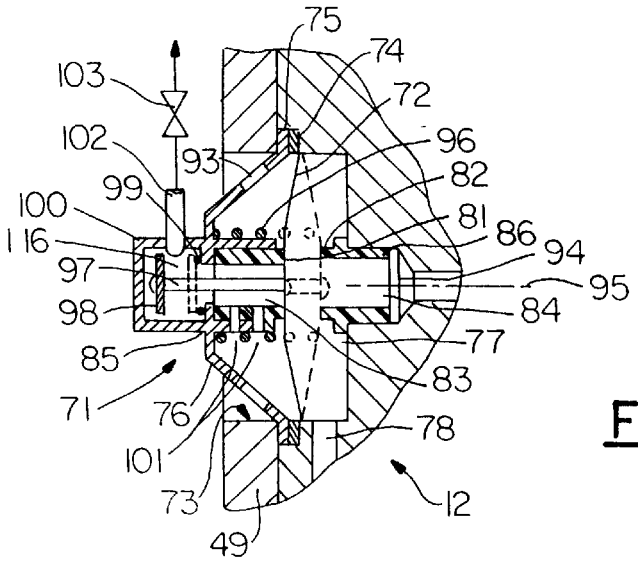
Figure 4:
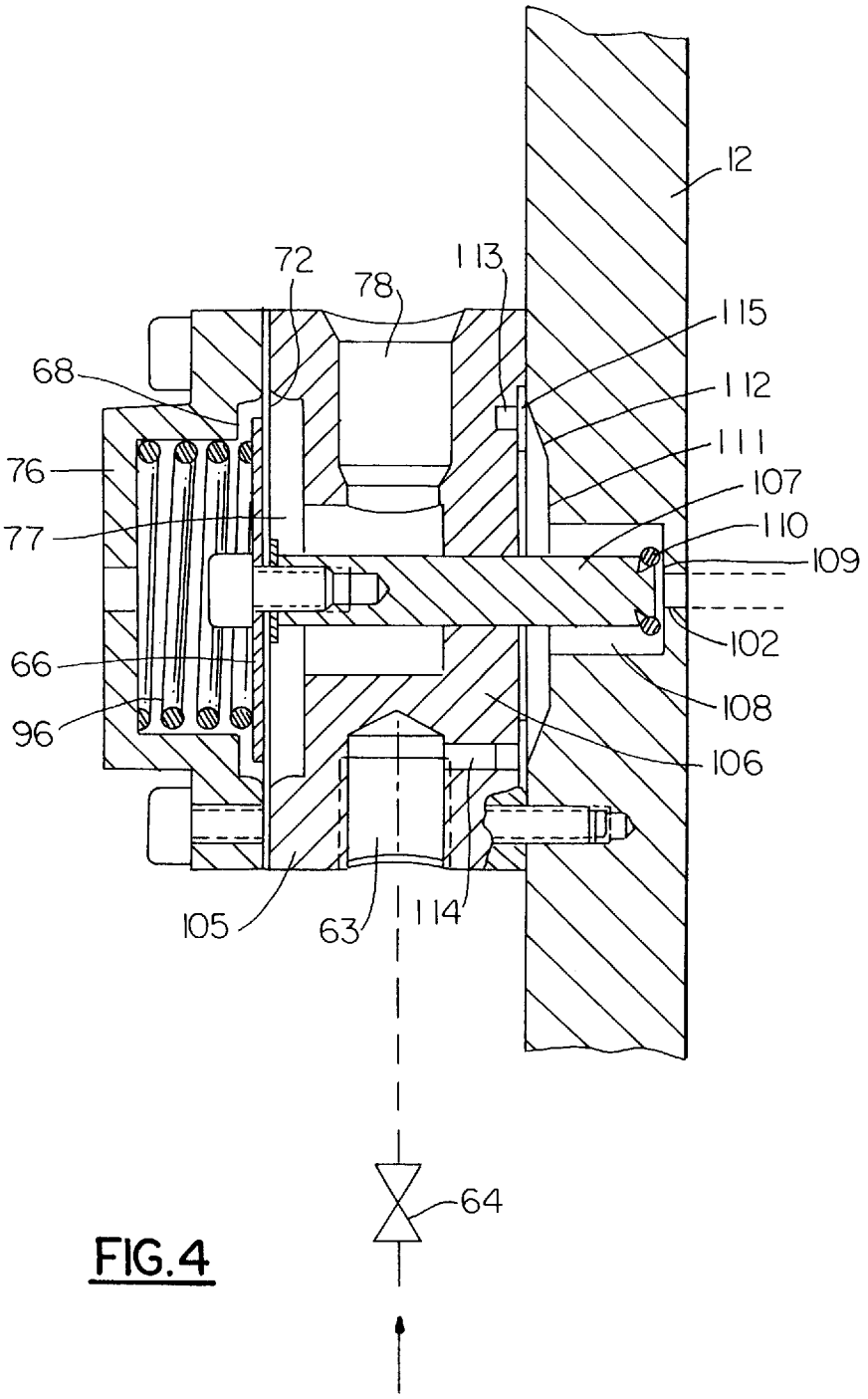

Drawing FIGS. 3 and 4 show further design implementations for a gas ballast feed valve.

DESCRIPTION OF THE DRAWINGS

The rotary vane vacuum pump 1 presented in drawing FIG. 1 substantially comprises assemblies housing 2, rotor 3 and drive motor 4.

Housing 2 substantially has the shape of a pot with an outer wall 5, with the lid 6, with an inside section 7 containing pump chambers 8, 9 as well as bearing bore 11 and with end piece 12 and bearing piece 13, which on their face sides limit the pump chambers 8, 9. The axis of the bearing bore 11 is designated as 14. Arranged eccentrically to this are the axes 15 and 16 of the pump chambers 8, 9. Oil space 17, which, during operation of the pump is partly filled with oil, is situated between outer wall 5 and the inside section 7. Two oil level glasses 18, 19 (maximum, minimum oil level) are provided in lid 6 for checking the oil level. Oil-fill and oil-drain ports are not shown.

Rotor 3 is situated within inside section 7. The rotor is made of one piece and has two anchor segments 21, 22 arranged on the face side and a bearing segment 23 situated between the anchor segments 21, 22. Bearing segment 23 and anchor segments 21, 22 are of identical diameter. Anchor segments 21, 22 are equipped with slots 25, 26 for vanes 27, 28. These are milled from each of the corresponding face sides of the rotor so that precise slot dimensions can be easily attained. Bearing segment 23 is situated between anchor segments 21, 22. Bearing segment 23 and bearing bore 11 form the sole bearing of the rotor. This bearing must have a sufficient axial length so as to avoid a gyratory motion of the rotor. Preferably the length of the bearing amounts to at least 10%, preferably 25% of the length of the entire rotor.

The anchor segment 22 and the corresponding pump chamber 9 are made longer than anchor segment 21 with pump chamber 8. Anchor segment 22 and pump chamber 9 form the high vacuum stage. During operation, the inlet of the high vacuum stage 9, 22 is linked to intake port 30. The discharge of the high vacuum stage 9, 22 and the inlet of the fore-vacuum stage 8, 21 are linked via bore 31 with its axis 32, which extends in parallel to axes 15, 16 of the pump chambers 8, 9. The discharge of the fore-vacuum stage 8, 21 leads to the oil space 17 which comprises oil sump 20. There the oil containing gases quieten down and leave the pump 1 through exhaust port 33. For reasons of clarity, the inlet and discharge openings of the two pump stages are not shown in drawing FIG. 1.

The bearing piece 13 is equipped with a bore 35 for the shaft 36 of the drive motor 4, said bore extending coaxially with respect to axis 14 of bearing bore 11. The shaft 36 is sealed off against the bearing piece 13 by shaft sealing rings 55 in recesses 56. The coupling of the rotor 3 to the drive shaft 36 is performed by way of a positive fit via cams and corresponding recesses. In the design example presented, the rotor 3 is equipped on its face side facing the shaft 36, with an oblong recess 38 which extends perpendicular to vane slot 26. The shaft 36 engages via a cam 40 into recess 38. The cam 40 of shaft 36 is in turn equipped with a recess 41, which embraces vane 28.

The pump according to drawing FIG. 1 is equipped with an oil pump. This consists of pump chamber 45 sunk into end piece 12 with an eccentric rotor 46 rotating within the pump chamber. A stopper 47 which is tensioned by spiral spring 48 rests against the eccentric. For accommodating the pump chamber 45 in end piece 12, this end piece is equipped with lid 52. The eccentric rotor 46 of the oil pump is driven via cam 53 on the fore-vacuum side face side of rotor 3. The inlet of the oil pump is connected to the oil sump 20 via a bore 51. All places of pump 1 which require oil are linked to the discharge of the oil pump, these being among others the valve system which is marked as a whole by designation 71 and which is also situated in the end piece 12 and which is presented in an enlargement in drawing FIG. 2.

The valve system 71 which is presented in an enlargement in drawing FIG. 2, is a diaphragm valve, the diaphragm 72 of which is situated within a recess 73 in end piece 12. It is attached at its peripheral area with the aid of rim 75, a convex cap 76 and lid 52 in recess 73. A line 78, to which a control pressure may be applied which depends on the operating mode of the pump 1, leads to partial space 77 which is sealed towards the outside by diaphragm 72. In the design example which is presented (drawing FIGS. 1, 2), the line 78 is connected to the discharge of the oil pump 45, 46, so that during operation of the pump 1 an increased oil pressure is present in partial space 77 of recess 73. Also the use of other control pressures of a vacuum pump—for example, the overpressure which arises at the exhaust of a pump against an exhaust filter—is possible.

Attached to diaphragm 72 is a formed part 58 having a cylindrical shape which extends into partial space 77 and where a hollow nipple 59 has been sunk into the unoccupied face side of the formed part. The formed part 58 with the hollow nipple 59, forms the closure piece of a valve which is equipped with a seal 60, the seat of said valve being the wall section 61 (bottom) of partial space 77. A bore 62 leads into wall section 61 centrally with respect to the nipple 59, said bore being linked to a gas ballast feed line 63. Incorporated in this line is also a valve 64 through which the gas ballast feed may be cut off manually. Moreover, bore or line 102 which is linked to the pump chamber leads into wall section 61. The leadout of line 102 is situated outside of the seal 60, so that bores 62, 102 may be linked or separated from each other with the aid of valve 59, 60, 61. In order to prevent the entry of oil into the gas ballast line, formed piece 65 made of elastomer which is attached to the housing, is present, and tightly embraces the closure piece defined by the formed port 58 and nipple 59.

Attached to the diaphragm 72 outside of partial space 77, is a support panel 66 having approximately the size of the unoccupied area of the diaphragm. A spring 96 is situated between the cap 76 and the support panel 66. The support panel is also equipped with a rim 67 edged towards the outside, to which a step 68 in cap 76 is related. This forms a stop for rim 67. The position of the step 68 is so selected that the diaphragm 72 can not be overelongated to the outside.

An increased oil pressure prevails in partial space 77 during operation of the pump. Owing to this pressure, the closure piece 58, 59 moves against the force of spring 96 and thus opens the connection between bores 62 and 102. When valve 64 is open, gas ballast may enter into the pump chamber. If the rotor 3 of the pump stops and thus also the rotor 46 of the oil pump, the oil pressure in partial space 77 reduces. The closure piece 58, 59 moves in its closing direction and separates the two bores 62 and 102 from each other. In the case of a failure of the pump, the gas ballast feed is thus interrupted even though valve 64 is open.

In the design example according to drawing FIG. 3 the diaphragm 72 is at the same time the actuator and the closure piece of the valve 71. It is so formed that it has only two stable positions. In one of its positions, it is drawn with full lines; the second position is in each case indicated by broken lines. The special characteristic of the diaphragm-shaped closure element 72 to revert to only two stable positions is attained by employing the snap-frog effect. This effect can be attained preferably with metallic diaphragms. Moreover, metallic diaphragms have the advantage of a longer service life compared to those made of plastic or an elastomer, in particular when these co-operate in a closure element with a sealing seat made of plastic or an elastomer.

The diaphragm 72, being the closure piece of the valve system 71 according to drawing FIG. 3, has two functions. Related to this are—on both sides of the diaphragm and opposing each other—two seats 81, 82 with passages 83, 84, which are formed by elastomer nipples 85, 86. The nipple 86 situated within partial space 77 is supported by piece 12, whereas the nipple 85 situated outside of partial space 77 is held by cap 76. Depending on the magnitude of the control pressure in partial space 77, the diaphragm 72 rests either at[2)] nipple 85 or nipple 86. Attached to the central area of diaphragm 72 is a valve stem 97 which penetrates passage 83. Outside cap 76 there is situated a closure piece 98 which is actuated by stem 97 and to which a sealing seat 99 at cap 76 is related and which is situated in a sealed chamber 100.

[2)] Translator's note: The word "an" (at) is missing in the German text and has been assumed for the translation, so that this sentence will make sense.

In a vacuum pump according to drawing FIG. 1, such a valve may be employed to control both the oil supply and the gas ballast feed to a pump chamber 8, 9 in a manner which depends on the operating mode. During operation, the diaphragm 72 maintains the position indicated by the full lines. Passage 84 is open. The gas ballast may enter through the openings 93 in the cap 76, through the bores 116 in nipple 85 which for diaphragm 72 has the function of a stop, through passage 83 and through chamber 101 into the line 102 with valve 103 which is connected to the pump chamber. When valve 103 is open, the gas ballast enters the pump chamber. If a gas ballast is not desired, valve 103 is closed.

When the rotor 3 and thus also rotor 46 of the oil pump stops, the oil pressure in the partial space 77 reduces. The diaphragm 72 and thus closure piece 98 revert to the position indicated by the broken lines. Oil supply and gas ballast feed are interrupted.

The change in the position of the diaphragm 72 from one position to its other position depends on the shape of the diaphragm 72 itself and on the pressure in partial space 77. The speed of the pressure build-up can be influenced with the aid of constriction 94 situated in line 95 which follows at passage 84 (drawing FIG. 2). The time of the switching over action for the diaphragm may also be influenced by a spring 96 which acts upon diaphragm 72. In the design example according to drawing FIG. 2, a pressure spring 96 is provided outside partial space 77, said pressure spring embracing nipple 85 and which is supported from the inside by cap 76 as well as the diaphragm 72.

In the design example according to drawing FIG. 4, a pot-shaped housing 105 which embraces partial space 77, is attached with its bottom 106 to end piece 12. The rim 74 of the diaphragm 72 is situated between cap 76 and the housing 105. Attached to the diaphragm 72 is a valve stem 107 which penetrates the bottom 106 of housing 105 and which terminates in an also pot-shaped recess 108 in the end piece 12. Bore 102 which is linked to the pump chamber leads out into the bottom 109 of the recess 108. Moreover, the bottom 109 of the recess 108 forms a valve seat which embraces the opening of bore 102 and which co-operates with the seal 110 at the valve stem 107. Actuation of the valve 109/110 is performed in the same manner, as described for in the design examples above, with the aid of the oil pressure.

The recess 108 first widens via a stage 111 and then via a conical section 112 to the outside. At the level of the conical section 112 there is situated in the bottom 106 of the housing 105 an annular groove 113, into which there ends a bore 114. This bore links the gas ballast feed line 63 to annular groove 113. Related to the annular groove 113 and the conical section 112 is an annular diaphragm 115 at the periphery between housing 105 and end piece 12. This forms a non-return valve for the gas ballast flow. When the gas ballast flows in the desired direction, the annular diaphragm 115 releases the annular groove 113. Excess strain on the annular diaphragm 115 is prevented by the conical section 112 to which the annular diaphragm attaches itself. In the resting state, or in case of overpressures in space 108, the annular diaphragm 115 rests on annular groove 113 so that oil or gas may not flow in the reverse direction.

We claim:

1. A vacuum pump with a closeable line through which gas ballast is fed into a pump chamber wherein the closeable line is equipped with a first and second control valve for the gas ballast feed, said first control valve being selectively controllable for limiting air into said pump chamber, operation of said second control valve being dependent on an operating mode of said pump, said second control valve operating such that the closeable line is closed in case of a failure of the pump, wherein said second control valve is a diaphragm valve and in which said vacuum pump is equipped with an oil pump having a rotor which is linked to a rotor of said vacuum pump in which control of the diaphragm valve is effected depending on the pressure of the oil supplied by the oil pump in which the second control valve includes a diaphragm sized to limit a sealed partial space, said vacuum pump including a gas supplying line and a connection line leading to the pump chamber, said diaphragm carrying a closure piece which serves the purpose of separating and connecting the gas supplying line and the connection line.

2. A vacuum pump according to claim 1, the second control valve is situated in a recess in an end piece of the vacuum pump.

3. A vacuum pump according to claim 1, including a pressure line to which a control pressure is applied, wherein said pressure line leads into the partial space.

4. A vacuum pump according to claim 1, including a recess in which the second control valve is situated.

5. A vacuum pump according to claim 4, including a non-return valve for the gas ballast flow.

6. A vacuum pump according to claim 5, wherein the non-return valve is situated between the partial space and the recess.

7. A vacuum pump according to claim 5, wherein the non-return valve is formed by an annular groove and an annular diaphragm.

8. A vacuum pump according to claim 7, wherein the partial space is situated in a housing which is placed onto an end piece such that the annular groove is situated on the bottom of the housing and in which the annular diaphragm is attached at a periphery thereof between the end piece and the housing.

9. A vacuum pump according to claim 1, wherein the outside of the diaphragm valve includes a support panel to which a stop is related.

10. A vacuum pump according to claim 9, including a cap which is attached to the diaphragm valve, the inside of the cap having the stop.

11. A vacuum pump according to claim 10, wherein a spring is supported between the cap and the diaphragm valve.

12. A vacuum pump according to claim 1, wherein the gas ballast feed and the supply of oil to the pump chamber of the vacuum pump is simultaneously controlled with a valve system.

13. A vacuum pump according to claim 1, wherein a valve is situated within the partial space to block the oil supply, and a valve is situated outside the partial space to block the gas ballast.

14. A vacuum pump according to claim 1 wherein the diaphragm valve maintains only a pair of biased stable positions, an open state position and a closed state position.

15. A vacuum pump according to claim 14, wherein the diaphragm valve includes a diaphragm which is made of a metal.

16. A vacuum pump according to claim 1, wherein a first seat is situated within the partial space.

17. A vacuum pump according to claim 16, including a second seat which is situated outside of the partial space.

18. A vacuum pump according to claim 1, wherein the diaphragm valve is linked to an actuator which serves the purpose of actuating the second control valve and in which the diaphragm valve forms, together with a sealing seat, the second control valve.

19. A vacuum pump according to claim 1, wherein the diaphragm valve includes a diaphragm which is engagedly influenced by a spring.

20. A vacuum pump according to claim 19, wherein the spring is one of the group consisting of a pressure spring and a helical spring.

21. A vacuum pump according to claim 1, wherein the discharge of the oil pump is connected to a partial space.

22. A vacuum pump with a closeable line through which gas ballast is fed into a pump chamber wherein the closeable line is equipped with a first and second control valve for the gas ballast feed, said first control valve being selectively controllable for limiting air into said pump chamber, operation of said second control valve being dependent on an operating mode of said pump, said second control valve operating such that the closeable line is closed in case of a failure of the pump, wherein said second control valve is a diaphragm valve and in which said vacuum pump is equipped with an oil pump having a rotor which is linked to a rotor of said vacuum pump in which control of the diaphragm valve is effected depending on the pressure of the oil supplied by the oil pump in which the second control valve includes a diaphragm sized to limit a sealed partial space, said vacuum pump including a recess in which the second control valve is situated and a non-return valve for the gas ballast flow, wherein the non-return valve is formed by an annular groove and an annular diaphragm and in which the partial space is situated in a housing which is placed onto an end piece such that the annular groove is situated in the bottom of the housing and in which the annular diaphragm is attached to a periphery thereof between the end piece and the housing.

23. A vacuum pump according to claim 22, wherein the non-return valve is situated between the partial space and the recess.

* * * * *